United States Patent [19]

Kruse

[11] Patent Number: 4,565,605

[45] Date of Patent: Jan. 21, 1986

[54] HEATING WALL FOR COKE-OVEN BATTERY

[75] Inventor: Dirk Kruse, Düsseldorf-Heerdt, Fed. Rep. of Germany

[73] Assignee: Bergwerksverband GmbH, Essen, Fed. Rep. of Germany

[21] Appl. No.: 476,527

[22] Filed: Mar. 18, 1983

[30] Foreign Application Priority Data

Mar. 19, 1982 [DE] Fed. Rep. of Germany ..... 3210108

[51] Int. Cl.[4] ..... C10B 29/02

[52] U.S. Cl. ..... 202/139; 202/223; 202/267 R; 202/268

[58] Field of Search ..... 202/223, 267 R, 268, 202/139, 140, 141, 142, 143, 144

[56] References Cited

U.S. PATENT DOCUMENTS

| | | | |
|---|---|---|---|
| 682,441 | 9/1901 | Wellman et al. | 202/267 |
| 1,989,459 | 1/1935 | Parker | 202/223 |
| 2,091,703 | 8/1937 | Denig | 202/268 |
| 2,839,453 | 6/1958 | Becker | 202/139 |
| 2,850,196 | 9/1958 | Feltz | 202/268 |
| 3,102,846 | 9/1963 | Tucker, Jr. | 202/223 |
| 3,792,769 | 2/1974 | Echterhoff . | |
| 4,039,342 | 8/1977 | Reerink et al. | 202/267 |
| 4,196,052 | 4/1980 | Szurman et al. | 202/223 |
| 4,259,159 | 3/1981 | Hahler | 202/267 |

FOREIGN PATENT DOCUMENTS

| | | | |
|---|---|---|---|
| 143332 | 10/1901 | Fed. Rep. of Germany . | |
| 2161980 | 1/1974 | Fed. Rep. of Germany . | |
| 2019078 | 1/1974 | Fed. Rep. of Germany . | |
| 1551842 | 1/1968 | France . | |
| 4710128 | 5/1972 | Japan | 202/223 |
| 806610 | 12/1958 | United Kingdom | 202/223 |

OTHER PUBLICATIONS

Chemical Engineering Progress, pp. 281–287, "The Role of Super Refractories", vol. 48, No. 6, Jun. 1952.

*Primary Examiner*—Peter Kratz

*Attorney, Agent, or Firm*—Karl F. Ross; Herbert Dubno

[57] ABSTRACT

A pair of adjacent horizontal coking chambers of a coke-oven battery are separated by a longitudinal wall with a multiplicity of vertical heating ducts, the wall being built from blocks which form two parallel frameworks defining the ducts between them. Each framework consists of longitudinal and transverse refractory blocks—preferably of silica—leaving rectangular apertures open toward the ducts and the chambers, these apertures being occupied by refractory plates of lower thermal resistance than the blocks. The transverse blocks of the two frameworks extend overlappingly between the ducts and have interfitting formations holding the frameworks together. The lower thermal resistance of the plates may be achieved by a reduction in wall thickness, compared with that of the over- and underlying longitudinal blocks, and/or by the choice of a more highly heat-conductive material therefor, preferably silicon carbide; in the latter case, tongue-and-groove joints between the frameworks and the plates should leave gaps sufficient for relative thermal expansion which may be filled with grouting and/or elastic inserts.

9 Claims, 3 Drawing Figures

HEATING WALL FOR COKE-OVEN BATTERY

FIELD OF THE INVENTION

My present invention relates to a heating wall separating adjacent horizontal coking chambers of a coke-oven battery and containing a multiplicity of vertical heating ducts spaced apart in the direction of its length.

BACKGROUND OF THE INVENTION

Such heating walls are generally made of refractory bricks or blocks designed to withstand the high operating temperatures of a coke oven, on the order of 1,000° C. An expeditious heating of the coal charge in the adjoining coking chambers is, of course, very desirable for economic reasons. This requires a high rate of heat transfer between the gases traversing the ducts and the chambers separated from them by respective layers of such blocks. The latter usually are made of silica which is a refractory material of reasonable dimensional stability at the operating temperatures employed. Its thermal conductivity, however, is not particularly high; thus, as discussed for example in German Pat. No. 2,161,980, the thickness of silica blocks bounding the heating ducts on the sides facing the coking chambers should be as small as possible.

For structural reasons it is, of course, necessary to preserve a certain minimum wall thickness. Since, furthermore, the temperature of the heating gases cannot be increased at will, another possible solution would be the replacement of silica by a more highly heat-conductive refractory material. A major attempt made with so-called magnesite blocks has proved unsuccessful because of the impossibility to control the reversible dimensional changes of these blocks with varying temperatures. In fact, all known refractory materials other than silica undergo a significant reversible thermal expansion at temperatures above 1,000° C., though in most instances not as large as with magnesite blocks. Silicon carbide (SiC), which has the highest heat conductivity among the usual refractories, has a thermal coefficient of expansion about half that of magnesite which still makes it very risky to use this material by itself in building blocks for a coke-oven wall.

German Pat. No. 143,332 describes a unitary refractory building block for a retort comprising a massive frame spanned by a thin-walled web. Such a block does have a lower thermal resistance than one of uniform thickness made of the same material, yet the thickness ratio between the frame and the web must be held within bounds in order to avoid cracks resulting from excessive differences in thermal expansion. Moreover, the size of such a unitary block is limited from a manufacturing viewpoint. Blocks of this type, even when provided with external tongues and grooves, are also difficult to use in a wall structure of a coke oven in which longitudinal and transverse blocks bounding the heating ducts are to be positively linked with one another by interlocking formations.

OBJECT OF THE INVENTION

Thus, the object of my present invention is to provide a thermally stable wall structure for the separation and heating of juxtaposed coking chambers in a coke-oven battery which affords improved heat transfer between the ducts and the chambers.

SUMMARY OF THE INVENTION

In accordance with my present improvement, each longitudinal wall separating two juxtaposed coking chambers comprises a frame structure of refractory blocks defining the ducts and forming columns of vertically spaced-apart apertures between each heating duct and the adjoining coking chambers, each of these apertures being occupied by a unitary refractory plate of lower thermal resistance than the surrounding blocks.

In principle, the reduction of the thermal resistance of the plates relative to that of the surrounding blocks may be brought about by a decrease in the thickness of the plates and/or by a choice of a different refractory material from them, preferably silicon carbide. Since the plates are not required to contribute significantly to the structural rigidity of the coke-oven wall, their thermal instability at the elevated operating temperatures will be of little consequence. With tongue-and-groove formations serving to interfit each plate with the surrounding blocks, the joints formed between them can provide sufficient clearance to allow for a relative thermal expansion of the plates without creating throughgoing passages. The resulting gaps existing between a plate and the surrounding blocks may be filled with pasty and/or granular substances but, advantageously, are occupied at least in part by elastic inserts able to withstand the high operating temperatures. Such fillers may include, for example, mineral fibers embedded in a mass of water glass or the like; they may be designed as strips disposed at least in the groove bottoms that are perpendicular to the major wall surfaces to keep them sealed.

BRIEF DESCRIPTION OF THE DRAWING

The above and other features of my invention will now be described in detail with reference to the accompanying drawing in which.

SPECIFIC DESCRIPTION

Figure 1:
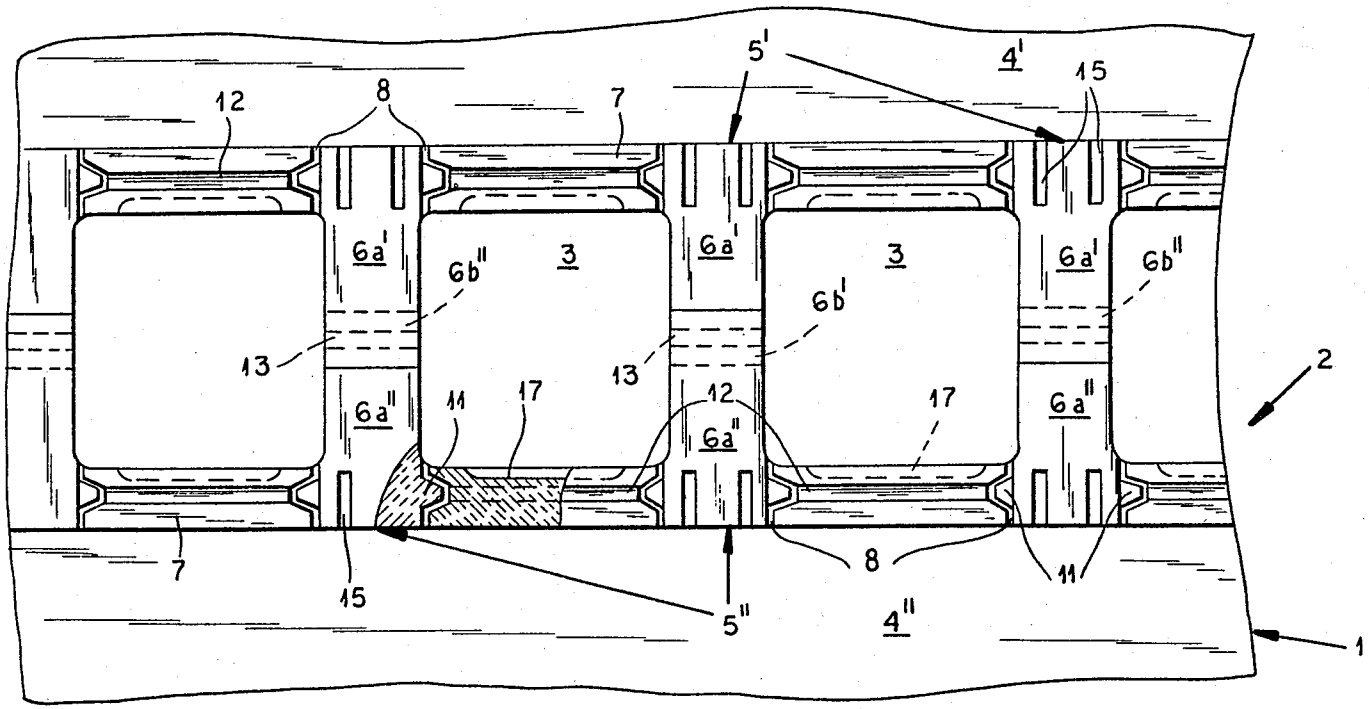
FIG. 1 is a plan view of a representative portion of a coke oven with two coking chambers separated by a heating wall according to the present improvement.

FIG. 1 shows part of a generally conventional coke-oven battery 1 with two horizontal coking chambers 4' and 4'' separated by a longitudinal wall 2. This wall is provided, as is likewise well known per se, with a multiplicity of vertical ducts 3 traversed by hot gases from a nonillustrated heating plant.

Figure 2:
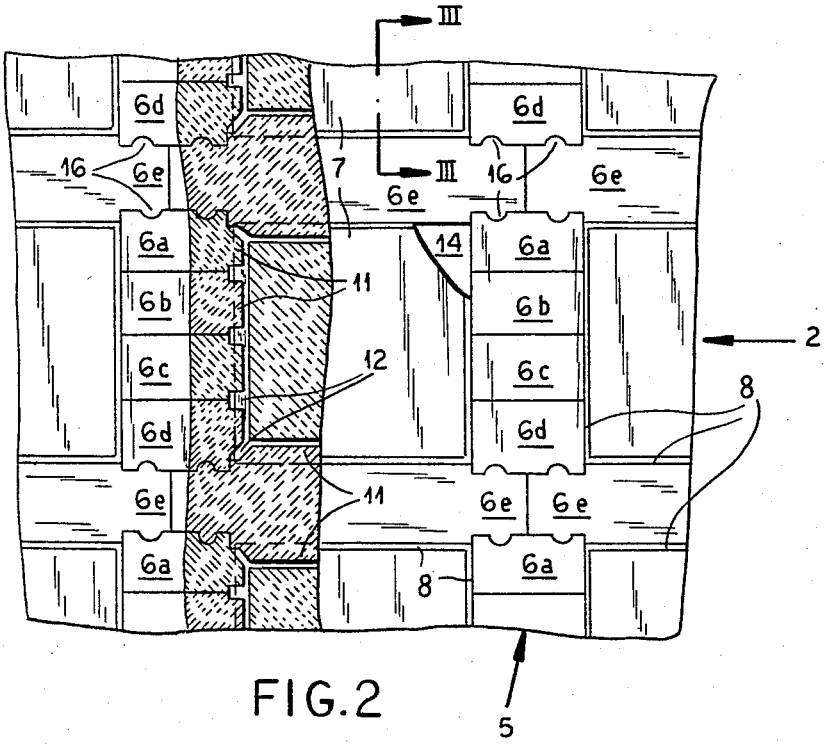
FIG. 2 is a fragmentary side-elevational view of the heating wall shown in FIG. 1.
Figure 3:
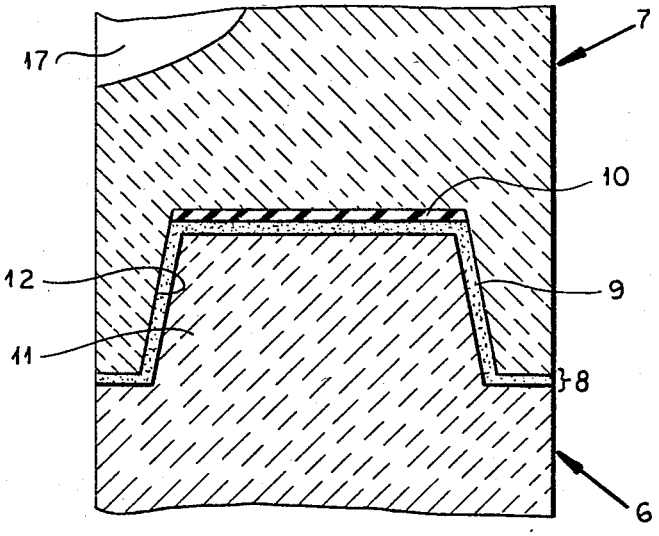
FIG. 3 is a sectional detail view taken on the line III—III of FIG. 2 and drawn to a larger scale.

In accordance with my present invention, and as more fully illustrated in FIGS. 2 and 3, chamber wall 2 is constructed from blocks generally designated 6 (FIG. 3). The blocks extend both longitudinally and transversely, in positively interlocked relationship, to form two frameworks 5' and 5'' respectively confronting the chambers 4' and 4''. As illustrated in FIG. 2 for one such framework, generically designated 5, transverse blocks *6a–6d* stacked four tiers high define with adjoining longitudinal blocks *6e* several columns of substantially square apertures 14 separated from one another within each column by blocks *6e*. The apertures of each column have a width substantially corresponding to that of a heating duct 3 (FIG. 1) aligned with that column and open onto that duct as well as onto the corresponding coking chamber. Each aperture is fully occupied by a refractory plate 7 of substantially the same square configuration fitting with slight play into the surrounding refractory blocks 6a–6e. The longitudinal blocks 6e separating any two horizontal rows of apertures 14 are positively interlocked by grooves 15 (FIG. 1) and tongues 16 (FIG. 2) with the top blocks 6a and the bottom blocks 6d of the transverse stacks respectively bounding the underlying and the overlying apertures; these connections also serve to interlink the adjoining blocks 6e of a row.

As will be seen in FIG. 1, blocks of a given tier in framework 5′ or 5″ are of different lengths in alternate transverse stacks so that aligned stacks of the two frameworks are interleaved for positive interconnection by tongue-and-groove formations indicated at 13. Thus, FIG. 1 shows longer upper-tier blocks 6a′ of framework 5′ abutting shorter blocks 6a″ and overlapping longer lower-tier blocks 6b″ of framework 5″ while a longer upper-tier block 6a″ of framework 5″ abuts a shorter block 6a′ and overlaps a longer lower-tier blocks 6b′ of framework 5′. The same overlapped interlinking occurs also in the underlying tiers. If desired, of course, the blocks could be additionally cemented to one another by mortar.

The more highly heat-conductive plates 7 have peripheral grooves 12 receiving substantially complementary tongues 11 of the surrounding blocks 6 as more fully illustrated in FIG. 3. These tongue-and-groove joints form narrow gaps 8 (exaggeratedly illustrated in FIG. 1) which allow for the thermal expansion of plates 7 and are occupied by suitable fillers preferably including elastic inserts 10 as described above. Part of each gap 8 may also be filled with granular material such as grout 9. As will be apparent from FIG. 3, the tongues and grooves 11, 12 have trapezoidal profiles with flank angles close to 90°; this insures that even an appreciable widening of the gap at the groove bottom, lined with the elastic insert 10, produces only a minor enlargement of the lateral gaps at the flanks. In an extreme case the profiles could be made rectangular rather than trapezoidal.

As further shown in FIGS. 1 and 3, plates 7 may be provided over a major part of their surfaces—especially on the sides facing the ducts 3—with depressions 17 in order to reduce their thickness to a minimum of about 5 cm. In such a case the plates could be made of the same refractory material as the blocks 6, namely silica; this, of course, would more or less eliminate the need for providing expansion-enabling gaps at the joints 8. Preferably, however, the refractory material of the plates has a higher heat conductivity than that of the blocks; thus, the plates may consist in whole or in part of silicon carbide as known per se from German Pat. No. 2,019,078.

If the apertures 14 and their covering plates 7 are so dimensioned that their combined area is approximately half that of the entire vertical surface area of wall 2, the use of SiC for these plates will increase the temperature on the outer wall surface by about 100° C., for a given heating-gas temperature, in comparison with that of a wall structure whose heating ducts are separated from the coking chambers by silica blocks of the same average thickness.

The described gridlike frame structure, being self-supporting, can also be installed above the foundations of existing coke-oven batteries that are to be rebuilt.

I claim:

1. In a coke-oven battery with a plurality of juxtaposed horizontal coking chambers separated by longitudinal walls each provided with a multiplicity of vertical heating ducts, the improvement wherein each of said longitudinal walls comprises a frame structure of refractory blocks of silica defining said heating ducts and forming columns of vertically spaced-apart rectangular apertures with vertical and horizontal sides between each heating duct and the adjoining coking chambers, said apertures being each occupied by a unitary silicon carbide refractory plate of lower thermal resistance than the surrounding blocks, said blocks being divided into longitudinal and transverse blocks, said structure consisting of two parallel frameworks each composed of longitudinal blocks between the apertures of a column and transverse blocks separating adjacent heating ducts from one another, the transverse blocks of said frameworks being provided with interlocking formations, said transverse blocks being stacked in a plurality of tiers along each vertical side of a respective aperture between horizontal rows of longitudinal blocks, the transverse blocks of said frameworks overlapping one another in alternate tiers.

2. A coke-oven battery as defined in claim 1 wherein extremities of said longitudinal blocks interlock with the transverse blocks of adjoining tiers.

3. A coke-oven battery as defined in claim 1 wherein said plates have major portions with a thickness less than that of said surrounding blocks.

4. A coke-oven battery as defined in claim 3 wherein the thickness of said major portions is about 5 cm.

5. A coke-oven battery as defined in claim 1 wherein said plates and said surrounding blocks have tongue-and-groove formations interfitting with sufficient clearance to enable thermal expansion of said plates.

6. A coke-oven battery as defined in claim 5 wherein gaps between said plates and said surrounding blocks are filled at least in part by elastic inserts.

7. A coke-oven battery as defined in claim 1 wherein said plates account for substantially 50% of the surface area of each longitudinal wall.

8. A coke-oven battery as defined in claim 1 wherein said apertures have a width substantially corresponding to that of said ducts.

9. A coke-oven battery as defined in claim 8 wherein said apertures are substantially square.

* * * * *